US007476057B2

(12) United States Patent
Arzberger et al.

(10) Patent No.: US 7,476,057 B2
(45) Date of Patent: Jan. 13, 2009

(54) METHOD AND TRENCH WALL CUTTING DEVICE FOR MAKING A TRENCH WALL IN THE SOIL

(75) Inventors: Maximilian Michael Arzberger, Igenhausen (DE); Ignaz Anton Seitle, Karlshuld (DE); Andreas Florian Peyerl, Hohenwart (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 147 days.

(21) Appl. No.: 11/206,857

(22) Filed: Aug. 19, 2005

(65) Prior Publication Data

US 2006/0039759 A1 Feb. 23, 2006

(30) Foreign Application Priority Data

Aug. 23, 2004 (EP) ..... 04019986

(51) Int. Cl.
*E02D 17/13* (2006.01)

(52) U.S. Cl. ..... 405/267; 37/189; 37/365; 37/94

(58) Field of Classification Search ..... 405/263, 405/266, 267; 37/189, 365, 94, 91, 347
See application file for complete search history.

(56) References Cited

U.S. PATENT DOCUMENTS 3,851,490 A 12/1974 Matsushita
4,084,648 A * 4/1978 Yahiro et al. ..... 175/67
4,694,915 A 9/1987 Bauer et al.
6,839,989 B2 * 1/2005 Gessay et al. ..... 37/189
7,152,346 B2 * 12/2006 Arzberger ..... 37/189
2004/0234345 A1 11/2004 Arzberger et al.

FOREIGN PATENT DOCUMENTS

| | | | |
|---|---|---|---|
| CH | 490579 | | 6/1970 |
| DE | 4008207 | A1 * | 8/1990 |
| DE | 4141629 | A1 * | 6/1993 |
| DE | 3424999 | C2 | 1/1994 |
| DE | 4141629 | C2 | 2/1997 |
| DE | 19530827 | A1 | 2/1997 |
| DE | 10308539 | B3 * | 6/2004 |
| DE | 10308538 | A1 | 9/2004 |
| EP | 1342851 | A1 | 9/2003 |

* cited by examiner

*Primary Examiner*—Sunil Singh
(74) *Attorney, Agent, or Firm*—Jacobson Holman PLLC

(57) ABSTRACT

The invention relates to a method for making a trench wall in the soil, in which a trench wall cutter having at least one rotatably driven cutting wheel is lowered into the soil, whereby soil material located below the cutting wheel is stripped and a cut trench is made and a settable liquid is supplied into the cut trench. For this purpose it is intended that a gas is supplied into the cut trench. The invention further relates to a trench wall cutting device for making a trench wall.

25 Claims, 3 Drawing Sheets

METHOD AND TRENCH WALL CUTTING DEVICE FOR MAKING A TRENCH WALL IN THE SOIL

The invention relates to a method for making a trench wall in the soil, in which a trench wall cutter having at least one rotatably driven cutting wheel is lowered into the soil, whereby soil material located below the cutting wheel is stripped and a cut trench is made, and a settable liquid is supplied into the cut trench.

The invention further relates to a trench wall cutting device for making a trench wall, comprising a frame, at least one cutting wheel rotatably supported on the frame and a drive, through which the cutting wheel can be set into a rotary motion, whereby soil material located below the cutting wheel can be stripped whilst forming a cut trench.

A method for making a trench wall in the soil is known from DE 195 30 827 C2. In this so-called two-phase method a cut trench is excavated in a first phase and the spoil resulting from the cut trench is conveyed above ground. The cut trench thus produced is filled with a support suspension whereby it is supported. In a second phase following the sinking of the cut trench a hardening suspension is supplied into the trench whilst displacing the support suspension.

In a one-phase method known from DE 41 41 629 C2 the trench is supported from the outset by a hardening suspension produced above ground by mixing excavated soil material with a settable liquid.

In order to carry out these known methods use can be made of the trench wall cutters known from DE 34 24 999 C2. These known trench wall cutters include a cutting frame and rotatably drivable cutting wheels that are supported at the underside of the frame. Soil material stripped by the cutting wheels is conveyed by the cutting wheels to a suction device mounted on the cutting frame and transported above ground.

From the German patent application bearing the reference number 103 08 538 a further generic method for making a trench wall is known. In this known method the hardening suspension is not produced outside the trench but directly inside the trench itself. To this end soil material stripped by the cutting wheels is mixed as it were "in situ" with the settable liquid in the cut trench as a result of the action of the cutting wheels, whereby a hardening liquid-soil mixture is produced. In this method the stripped soil material which is intermixed with the settable liquid is at least partly left in the cut trench where it can harden to form the trench wall. As a result, there is no longer any need for the entire stripped soil material to be conveyed above ground in a complicated manner by employing pumping devices.

To supply the settable liquid into the cut trench a supply device arranged on the frame of the trench wall cutter is known from the German patent application bearing the reference number 103 08 538.

The object of the present invention is to provide a method and a trench wall cutting device for making a trench wall in the soil, by means of which trench walls of a particularly high quality can be made.

This object is solved in accordance with the invention by a method having the features of claim 1 and by a trench wall cutting device having the features of claim 8. Preferred embodiments are stated in the respective subclaims.

The method in accordance with the invention is characterized in that a gas, in particular air, is supplied into the cut trench in a defined manner.

A basic idea of the invention may be seen in the fact that during the cutting a gas is supplied into the cut trench in addition to the settable liquid. This gas emerges in the cut trench and rises upwards in the suspension present in the cut trench. This movement of the gas provides a particularly good intermixing of the hardening suspension located in the cut trench and therefore allows the production of trench walls of a particularly high quality. As a result of the addition of gas in accordance with the invention in particular a settling of larger and/or heavier suspended particles can be counteracted and thus a particularly good homogeneity can be achieved in the suspension which leads to trench walls that are particularly homogeneous and have a very high quality. Moreover, through the addition of gas a premature hardening of the settable suspension, in particular in parts, can be counteracted.

According to the invention the hardening or settable suspension is understood as a suspension produced through the mixing of the settable liquid with the stripped soil material. A practical way is that the settable suspension is produced directly in the cut trench itself, i.e. the intermixing of the settable liquid with the soil material takes place in the cut trench, more particularly in the portion of the cutting wheel and as a result of the cutting wheel action.

Contrary to a drilling method in which the axis of rotation of an earth working tool coincides with its advance direction, the method according to the invention is a cutting method in which at least one earth working tool designed as a cutting wheel is rotated about an axis of rotation that is arranged angularly, i.e. not parallel to the advance direction. In accordance with the invention the at least one cutting wheel is rotatably driven, for which reason a drive is provided. Advantageously, two paraxially driven cutting wheels or two paraxially driven cutting wheel pairs are provided at the bottom of the trench wall cutter.

As far as its composition is concerned the gas supplied into the cut trench can in principle be chosen as desired. However, it is particularly economical to use air that can be pumped from the environment of the cut trench for example. It is suitable for the gas to be supplied at high pressure into the cut trench.

Basically, it is possible to supply the gas and/or the settable liquid at any chosen point in the cut trench. However, for a particularly effective intermixing it is advantageous if the gas and/or the liquid is supplied in the bottom portion of the cut trench. For the purpose of supplying the gas and/or the settable liquid supply devices can generally be provided which are separate from the trench wall cutter and/or spaced therefrom. For instance a joint supply pipe or separate pipes for the gas and the settable liquid can be introduced into the cut trench in addition to the trench wall cutter. However, according to the invention it is of particular advantage that the gas and/or the settable liquid are supplied into the cut trench at a frame of the trench wall cutter, especially in the portion of the cutting wheel. By supplying the gas and/or the settable liquid in this portion the mixing effect of the rotating cutting wheels can be used in a particularly efficient way and the homogeneity and quality of the trench wall to be produced are thereby improved further. According to this embodiment, it is advantageous that the supply devices for the gas and/or the settable liquid are arranged on the trench wall cutter, in particular at its frame. By preference, the gas and/or the settable liquid are supplied centrally between two paraxial cutting wheels or cutting wheel pairs. The gas and/or the settable liquid can be supplied into the cut trench at one or several points of supply.

In principle, it is possible to direct the flow of the supplied gas and/or of the supplied settable liquid in the cut trench as desired. In this connection the flow of the supplied materials is understood as the flow that is formed immediately during the supply, i.e. on emerging from the respective supply devices, and that may also be present if the cutting wheels are inoperative and the trench wall cutter is stationary. What is not understood by this in particular is the movement of the gas or liquid resulting from the agitation of the cutting wheels or from lifting forces.

However, according to the invention it is particularly preferred that the flow of the supplied gas and/or of the supplied settable liquid is directed onto the cutting wheel. As a result, it is possible for the cutting wheel to be flushed free from stripped soil material in a particularly effective manner, whereby a particularly good cutting progress can be attained. It is suitable for the flow of the supplied gas and/or of the supplied settable liquid to be directed at least approximately to the advance direction. More particularly, the flow can be tangent to, i.e. tangentially touch at least one cutting wheel, preferably two cutting wheels or two cutting wheel pairs. To this end discharge openings of the supply devices are arranged preferably at the centre between the cutting wheels that are suitably disposed in a paraxial manner.

A particularly preferred embodiment of the invention is characterized in that the gas is supplied into the cut trench with a flow profile which surrounds a flow profile of the settable liquid in particular in a concentric manner during its supply or which is surrounded by this flow profile in particular in a concentric manner. Here the flow profile can be understood as the cross section through the flow during the supply of the gas and/or the settable liquid perpendicularly to the flow direction. Hence, according to this embodiment it is intended that the flows of the gas and the settable liquid surround each other at least partly. For this purpose the supply devices can have a ring nozzle for example. It is especially preferred that the gas is lead externally around the liquid in a concentric manner in particular. In this case the efficiency of the liquid jet can be improved and in particular a greater jet range can be achieved.

Basically, the gas can be supplied into the cut trench at any chosen operating condition of the trench wall cutter. It is particularly preferred that the gas is supplied during the lowering and/or drawing of the trench wall cutter, especially during the operation of the at least one cutting wheel. Provision can also be made for the trench wall cutter to be put temporarily out of service in the advance direction during the supply of gas, i.e. that neither a lowering nor a drawing movement is carried out. In principle, the supply of the gas can preferably be continued even upon completion of the drawing of the trench wall cutter from the cut trench.

In accordance with a further embodiment of the present invention it is intended that the gas is supplied into the cut trench with a gas pressure which is varied as a function of the current cutting depth of the trench wall cutter. This embodiment proves to be of particular advantage if the gas is supplied into the cut trench at the frame of the trench wall cutter, i.e. at a point of supply that is dependent on the cutting depth. Through the present embodiment it is possible to take into account the changes of the hydrostatic pressure occurring in the cut trench at a variable cutting depth and to supply the gas for instance at an at least approximately constant high overpressure relative to the ambient pressure of the trench wall cutter. However, it ;is also possible to change the gas pressure with the hydrostatic pressure in a disproportionately high or low manner for example.

Furthermore, it is of particular advantage that the settable liquid is intermixed with stripped soil material in the cut trench, due particularly to the cutting wheel action, whilst forming a hardening suspension. Hence, according to this embodiment the suspension is produced "in situ" in the cut trench and not, in particular, above ground. Here the cutting wheel serves to strip soil material as well as to subsequently intermix this soil material with the settable liquid.

The trench wall cutting device according to the invention is characterized in that a gas conveying device is provided for a defined supply of a gas into the cut trench. The trench wall cutting device according to the invention is particularly suitable to carry out the method according to the invention, whereby the advantages set out in connection herewith can be achieved. By the defined supply within the meaning of the invention it can be understood in particular that the gas is conveyed in a specific manner into the cut trench by means of a device provided for this purpose and that it is not simply dragged along for example during the sinking of the trench wall cutter and set free afterwards. The gas conveying device can also be referred to as supply device for the gas.

In order to achieve a particularly good intermixing of the suspension provision can be made according to the invention for the gas conveying device to include at least a gas supply nozzle, which is arranged on the frame, especially in the portion of the cutting wheel. By preference, the gas supply nozzle is arranged centrally between two adjacent, in particular paraxial cutting wheels or cutting wheel pairs.

Furthermore, it is of particular advantage that a liquid conveying device is provided for supplying a settable liquid into the cut trench, with the liquid conveying device having at least a liquid supply nozzle that is arranged on the frame, more particularly in the portion of the cutting wheel. The liquid conveying device may also be referred to as supply device for the settable liquid. It is suitable for the liquid supply nozzle to be arranged centrally between two cutting wheels or cutting wheel pairs that are preferably arranged paraxially.

According to the invention a particularly great jet range may be provided for the gas and/or liquid jet in that the gas supply nozzle surrounds the liquid supply nozzle preferably in an annular and/or concentric manner or that it is surrounded by this liquid supply nozzle preferably in an annular and/or concentric manner. To this end the gas supply nozzle and/or the liquid supply nozzle are suitably designed as a ring nozzle or ring segment nozzle.

In accordance with the invention provision can be made for the gas and/or the settable liquid to be supplied into the cut trench at one or several separate points respectively. If a supply at several points in the cut trench is intended, several supply devices, especially several supply nozzles, can be provided for this purpose.

In order to generate a gas flow for the defined supply of the gas into the cut trench provision can be made in particular for the gas conveying device to include a gas-pressure generating device arranged outside the cut trench. The gas-pressure generating device may include for instance a pump, in particular a piston pump, and/or also a pressure tank. Advantageously, the gas conveying device serves to convey atmospheric air into the cut trench.

A particularly good cleaning of the at least one cutting wheel from soil material and thus a particularly good cutting progress can be achieved in that the gas supply nozzle and/or the liquid supply nozzle is directed onto the at least one cutting wheel. It is suitable for the gas flow of the gas supply nozzle and/or the liquid flow of the liquid supply nozzle to be tangent to the cutting wheel. More particularly, these flows can also be tangent to two adjacent cutting wheels at the same time, i.e. they can flow tangentially on said wheels.

The gas supply nozzle and/or the liquid supply nozzle can have a circular or slot-shaped opening cross section.

In the following the invention is described in greater detail by way of preferred embodiments depicted in the Figures. In the Figures the following is schematically shown:

Elements having the same function are designated with the same reference signs throughout all Figures.

Figure 1:
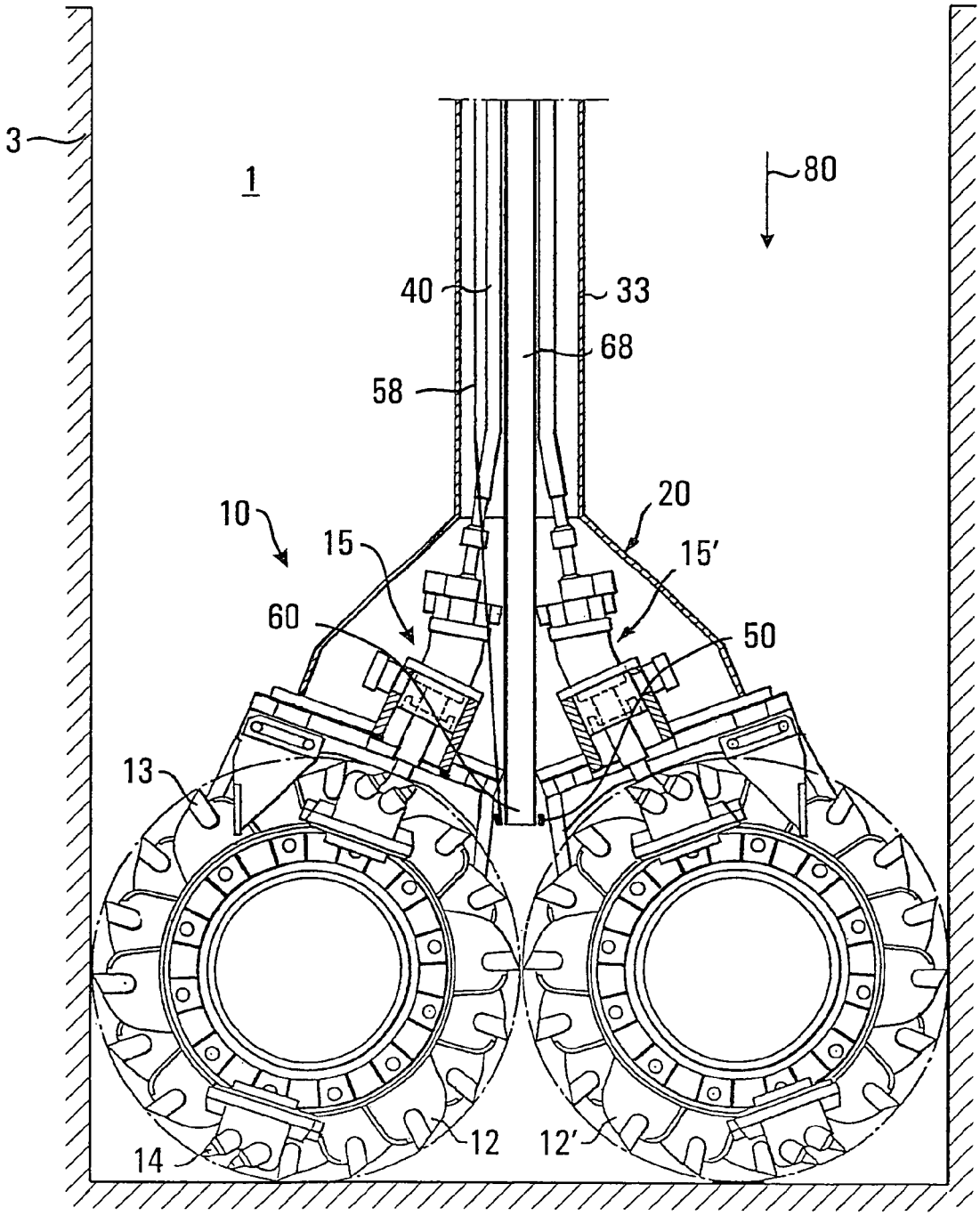
FIG. 1 shows a partly sectional front view of a trench wall cutting device according to the invention.

A trench wall cutting device in accordance with the invention is shown in FIG. 1. It comprises a trench wall cutter 10 having a frame 20, on the bottom of which two cutting wheels 12, 12' are rotatably supported. The cutting wheels 12, 12' are designed as cutting wheel pairs having two single cutting wheels each that are arranged consecutively and coaxially in a manner perpendicular to the plane of the drawing. At the circumference of the cutting wheels 12, 12' cutting teeth 13 and hinged teeth 14 are provided that can be pivoted perpendicularly to the plane of the drawing.

To rotatably drive the two paraxially arranged cutting wheels 12, 12' two drives 15, 15' designed as hydraulic rotary motors are provided on the frame 20, which are supplied with hydraulic fluid via supply lines 40.

By lowering the trench wall cutter 10 in the advance direction 80 into the soil 3 and by simultaneously operating the cutting wheels 12, 12' a cut trench 1 of approximately rectangular cutting cross section is formed in the soil 3.

In addition, the trench wall cutting device has a liquid supply device for supplying a settable liquid into the cut trench 1. This liquid supply device has a liquid line 68 which, starting from a liquid pump not depicted in the Figure, extends inside a guide rod 33 of the frame 20 in the advance direction 80 to the frame 20 where it terminates in a liquid supply nozzle 60. The liquid supply nozzle 60 is arranged in such a manner between the two cutting wheels 12, 12' that the liquid jet emerging from the nozzle in the advance direction 80 tangentially touches the teeth 13, 14 of both cutting wheels 12, 12' arranged next to each other and thereby flushes them free from stripped soil material.

Moreover, the trench wall cutting device includes a gas conveying device which can also be referred to as gas supply device. This gas conveying device has a gas line 58 which, starting from a gas-pressure generating device not shown in FIG. 1 and arranged outside the cut trench 1, extends inside the guide rod 33 to the frame 20 where it terminates in a gas supply nozzle 50. The gas supply nozzle 50 is designed as a ring nozzle that annularly surrounds the liquid supply nozzle 60 which is provided with a circular supply cross section. On account of this arrangement the gas supply nozzle 50 is arranged centrally between the two cutting wheels 12, 12' and the gas flow emerging from the gas supply nozzle 50 is directed tangentially to the cutting teeth 13, 14 of both cutting wheels 12, 12'. In this manner the gas jet surrounds the liquid jet in an annular manner.

The frame 20 is designed such that its cross section is considerably smaller than the cutting cross section of the two cutting wheels 12, 12' so that in the portion of the cutting wheels 12, 12' and above an intermixing of the soil material stripped from the bottom of the cut trench 1 by the cutting wheels 12, 12' with the settable liquid supplied from the liquid supply nozzle 60 can take place whilst being unhindered to a large extent by the geometry of the frame 20.

Figure 2:
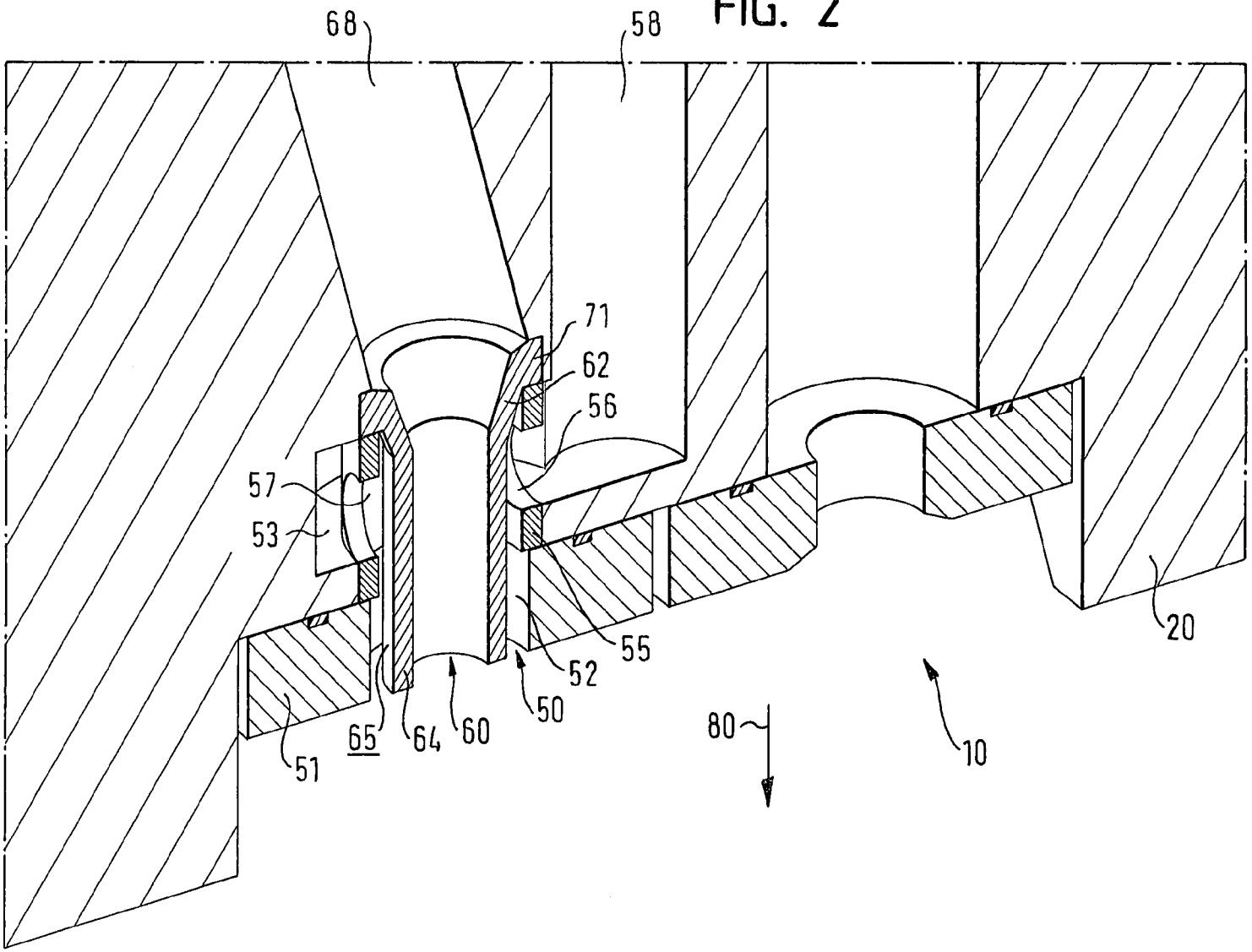
FIG. 2 shows a partly sectional, perspective detailed view of a gas supply nozzle and a liquid supply nozzle arranged in the frame of a further trench wall cutting device according to the invention.

A detailed view of a further trench wall cutting device according to the invention is illustrated in FIG. 2. FIG. 2 shows a frame 20 of a trench wall cutter 10 according to the invention, on which a gas supply nozzle 50 and a liquid supply nozzle 60 are arranged. For the sake of clarity neither the cutting wheels nor their drives are depicted in FIG. 2.

For the supply of the liquid supply nozzle 60 a liquid line 68 is provided in the frame 20. The liquid supply nozzle 60 is formed by an end-sided opening located in a substantially cylindrical liquid nozzle element 65. In its inflow portion disposed subsequently to the liquid line 68 the liquid nozzle element 65 has a cone frustum-shaped portion 62, in which the flow cross section for the liquid tapers off. This cone frustum-shaped portion 62 is followed in the flow direction by a cylindrical portion 64 at whose end the liquid supply nozzle 60 is designed. The cylindrical portion 64 and the cone frustum-shaped portion 62 of the liquid nozzle element 65 are arranged coaxially to each other with a centre axis that extends parallel to the advance direction 80 of the trench wall cutter 10.

For the supply of the gas supply nozzle 50 with gas, a gas line 58 is provided in the frame 20. While the gas line 58 extends parallel to the advance direction 80 in the portion of the nozzles 60, 50, the liquid line 68 is arranged at an angle thereto.

The gas supply nozzle 50 is designed as an annular ring nozzle which surrounds the liquid nozzle 60 designed with a circular cross section. The gas supply nozzle 50 is designed between the outer wall of the cylindrical portion 64 of the liquid nozzle element 65 and the cylindrical inner wall of a passage opening 52 of an annular-like hole element 51 that surrounds the cylindrical portion 64 of the liquid nozzle element 65 in its lower portion. The hole element 51, which can also be referred to as exchangeable nozzle holder, is detachably arranged at the underside of the frame 20.

In order to supply gas to the gas supply nozzle 50 an annular chamber 53 is designed in the frame 20, which annularly surrounds the cylindrical portion 64 and the cone frustum-shaped portion 62 of the liquid nozzle element 65 above the hole element 51 and which is in fluid connection with the gas line 58 via an opening located in its outer annular wall. In the inside of the annular chamber 53 a cylinder element 55 is arranged, in the shell of which four passage openings 56 with each having a round cross section are designed. The passage openings 56 are each offset by 90° with respect to each other around the axial direction that coincides with the advance direction 80. The gas coming from the annular chamber 53 can flow through the passage openings 56 radially inwards into an intermediate space 57 formed between the cylinder element 55 and the cylindrical portion 64 as well as the cone frustum-shaped portion 62 of the liquid nozzle element 65. From this intermediate space 57 the gas can in turn flow axially along the liquid nozzle element 65 into the passage opening 52 of the hole element 51 and thus the gas can flow to the gas supply nozzle 50.

At its inflow side the liquid nozzle element 65 has a broadened edge 71 in its cone frustum-shaped portion 62, where the liquid nozzle element 65 rests on the upper front face of the cylinder element 55. At its lower front face the cylinder element 55 rests for its part on the hole element 51. For the maintenance of the device the annular hole element 51 can be removed from the frame 20, whereby the cylinder element 55 is released axially and can also be removed. Through this the liquid nozzle element 65 is in turn released axially.

Figure 4:
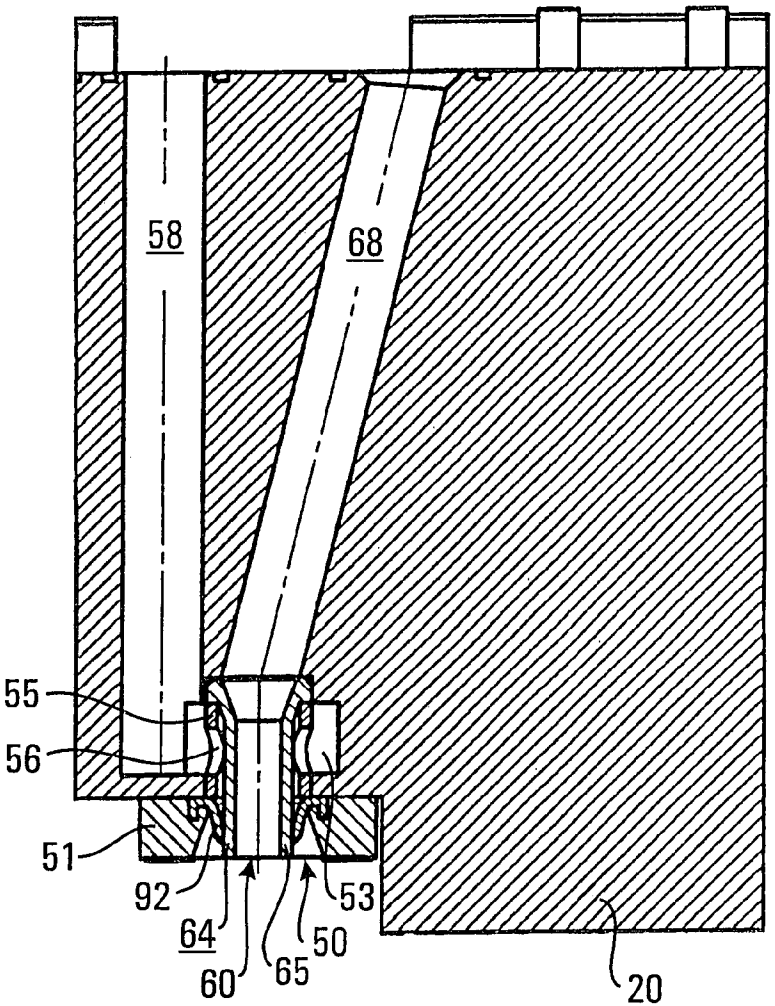
FIG. 4 shows a partial view of the section A-A of the frame from FIG. 3.
Figure 3:
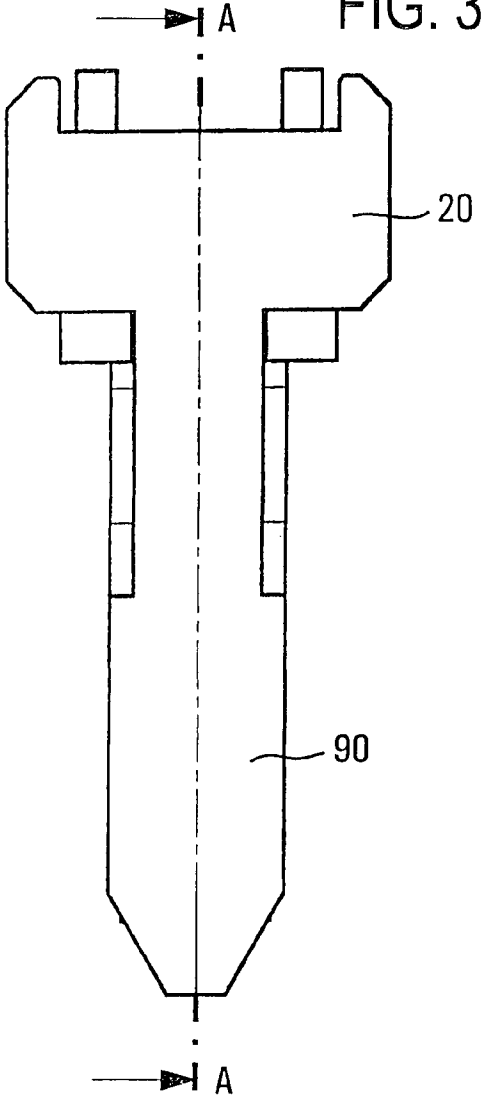
FIG. 3 shows a lateral view of a frame of a further trench wall cutting device according to the invention.

A frame 20 of a further embodiment of a trench wall cutting device in accordance with the invention is illustrated in FIGS. 3 and 4. As can be taken from FIG. 3, the frame 20 has at is underside a cutting shield 90 with a reduced cross section, at both sides of which the cutting wheels not shown in FIG. 3 are supported.

The embodiment shown in FIGS. 3 and 4 essentially differs from the embodiment shown in FIG. 2 in that an annular sealing lip 92 is provided in the annular hole element 51, which rests on the outer wall of the cylindrical portion 64 of the liquid nozzle element 65. If the gas pressure present in the gas supply device exceeds the hydrostatic liquid pressure present at the gas supply nozzle 50, the sealing lip 92 opens and the gas can flow from the annular chamber 53 into the gas supply nozzle 50 and from there into the trench. However, if the gas pressure in the gas supply device is lower than the hydrostatic liquid pressure, the sealing lip 92 shuts off so that an inflow of suspension into the gas supply device is prevented.

In addition, contrary to the embodiment of FIG. 2 the gas supply nozzle 50 of the embodiment of FIG. 4 does not have a cylindrical but a cone-like design in its lower portion.

The invention claimed is:

1. Method for making a trench wall in the soil, using a trench wall cutter comprising:

a frame, at least one cutting wheel rotatably supported on the frame, drive means for setting the cutting wheel into a rotary motion, for stripping soil material located below the cutting wheel whilst forming a cut trench, liquid conveying means for supplying a settable liquid into the cut trench, wherein the liquid conveying means has at least one liquid supply nozzle which is arranged on the frame, and wherein the liquid supply nozzle is directed to the at least one cutting wheel, and gas conveying means for providing a defined supply of a gas into the cut trench, wherein the gas conveying means includes at least a gas supply nozzle which is arranged on the frame, and wherein the gas supply nozzle is directed to the at least one cutting wheel, the method comprising the steps of:

lowering the trench wall cutter into the soil and rotating the at least one rotatably driven cutting wheel, to strip the soil material located below the cutting wheel and make a cut trench, supplying a settable liquid into the cut trench at the frame of the trench wall cutter using the at least one liquid supply nozzle, with the flow of the supplied settable liquid being directed to the cutting wheel, and supplying a gas into the cut trench in a defined manner at the frame of the trench wall cutter using the at least one gas supply nozzle, with the flow of the supplied gas being directed to the cutting wheel, and with a flow profile which surrounds a flow profile of the settable liquid during its supply.

2. Method according to claim 1, wherein the gas is supplied during at least one of lowering the trench wall cutter into the soil and drawing of the trench wall cutter out of the soil.

3. Method according to claim 2, wherein the gas is supplied during the operation of the at least one cutting wheel.

4. Method according to claim 1, wherein the gas is supplied into the cut trench with a gas pressure which is varied as a function of the current cutting depth of the trench wall cutter.

5. Method according to claim 1, further comprising the step of using the action of the cutting wheel to intermix the settable liquid in the cut trench with stripped soil material to produce a hardening suspension.

6. Method according to claim 1, wherein the gas is air.

7. Method according to claim 1, wherein at least one of the gas and the settable liquid is supplied in the vicinity of the cutting wheel.

8. Method for making a trench wall in the soil, using a trench wall cutter comprising:

a frame, at least one cutting wheel rotatably supported on the frame, drive means for setting the cutting wheel into a rotary motion, for stripping soil material located below the cutting wheel whilst forming a cut trench, liquid conveying means for supplying a settable liquid into the cut trench, wherein the liquid conveying means has at least one liquid supply nozzle which is arranged on the frame, and wherein the liquid supply nozzle is directed to the at least one cutting wheel, and gas conveying means for providing a defined supply of a gas into the cut trench, wherein the gas conveying means includes at least a gas supply nozzle which is arranged on the frame, and wherein the gas supply nozzle is directed to the at least one cutting wheel, the method, comprising the steps of:

lowering the trench wall cutter into the soil and rotating the at least one rotatably driven cutting wheel, to strip the soil material located below the cutting wheel and make a cut trench, supplying a settable liquid into the cut trench at the frame of the trench wall cutter using the at least one liquid supply nozzle, with the flow of the supplied settable liquid being directed to the cutting wheel, and supplying a gas into the cut trench in a defined manner at the frame of the trench wall cutter using the at least one gas supply nozzle, with the flow of the supplied gas being directed to the cutting wheel, and with a flow profile which surrounds a flow profile of the settable liquid in a concentric manner during its supply.

9. Method according to claim 8, wherein the gas is supplied during at least one of lowering the trench wall cutter into the soil and drawing of the trench wall cutter out of the soil.

10. Method according to claim 9, wherein the gas is supplied during the operation of the at least one cutting wheel.

11. Method according to claim 8, wherein the gas is supplied into the cut trench with a gas pressure which is varied as a function of the current cutting depth of the trench wall cutter.

12. Method according to claim 8, further comprising the step of using the action of the cutting wheel to intermix the settable liquid in the cut trench with stripped soil material to produce a hardening suspension.

13. Method according to claim 8, wherein the gas is air.

14. Method for making a trench wall in the soil, using a trench wall cutter comprising:

a frame, at least one cutting wheel rotatably supported on the frame, drive means for setting the cutting wheel into a rotary motion, for stripping soil material located below the cutting wheel whilst forming a cut trench, liquid conveying means for supplying a settable liquid into the cut trench, wherein the liquid conveying means has at least one liquid supply nozzle which is arranged on the frame, and wherein the liquid supply nozzle is directed to the at least one cutting wheel, and gas conveying means for providing a defined supply of a gas into the cut trench, wherein the gas conveying means includes at least a gas supply nozzle which is arranged on the frame, and wherein the gas supply nozzle is directed to the at least one cutting wheel, the method comprising the steps of:

lowering the trench wall cutter into the soil and rotating the at least one rotatably driven cutting wheel, to strip the soil material located below the cutting wheel and make a cut trench, supplying a settable liquid into the cut trench at the frame of the trench wall cutter using the at least one liquid supply nozzle, with the flow of the supplied settable liquid being directed to the cutting wheel, and supplying a gas into the cut trench in a defined manner at the frame of the trench wall cutter using the at least one gas supply nozzle, with the flow of the supplied gas being directed to the cutting wheel, and with a flow profile which is surrounded by a flow profile of the settable liquid during its supply.

15. Method according to claim 14, wherein the gas is supplied during at least one of lowering the trench wall cutter into the soil and drawing of the trench wall cutter out of the soil.

16. Method according to claim 15, wherein the gas is supplied during the operation of the at least one cutting wheel.

17. Method according to claim 14, wherein the gas is supplied into the cut trench with a gas pressure which is varied as a function of the current cutting depth of the trench wall cutter.

18. Method according to claim 14, further comprising the step of using the action of the cutting wheel to intermix the settable liquid in the cut trench with stripped soil material to produce a hardening suspension.

19. Method according to claim 14, wherein the gas is air.

20. Method for making a trench wall in the soil, using a trench wall cutter comprising:

a frame, at least one cutting wheel rotatably supported on the frame, drive means for setting the cutting wheel into a rotary motion, for stripping soil material located below the cutting wheel whilst forming a cut trench, liquid conveying means for supplying a settable liquid into the cut trench, wherein the liquid conveying means has at least one liquid supply nozzle which is arranged on the frame, and wherein the liquid supply nozzle is directed to the at least one cutting wheel, and gas conveying means for providing a defined supply of a gas into the cut trench, wherein the gas conveying means includes at least a gas supply nozzle which is arranged on the frame, and wherein the gas supply nozzle is directed to the at least one cutting wheel, the method comprising the steps of:

lowering the trench wall cutter into the soil and rotating the at least one rotatably driven cutting wheel, to strip the soil material located below the cutting wheel and make a cut trench, supplying a settable liquid into the cut trench at the frame of the trench wall cutter using the at least one liquid supply nozzle, with the flow of the supplied settable liquid being directed to the cutting wheel, and supplying a gas into the cut trench in a defined manner at the frame of the trench wall cutter using the at least one gas supply nozzle, with the flow of the supplied gas being directed to the cutting wheel, and with a flow profile which is surrounded by a flow profile of the settable liquid in a concentric manner during its supply.

21. Method according to claim 20, wherein the gas is supplied during at least one of lowering the trench wall cutter into the soil and drawing of the trench wall cutter out of the soil.

22. Method according to claim 21, wherein the gas is supplied during the operation of the at least one cutting wheel.

23. Method according to claim 20, wherein the gas is supplied into the cut trench with a gas pressure which is varied as a function of the current cutting depth of the trench wall cutter.

24. Method according to claim 20, further comprising the step of using the action of the cutting wheel to intermix the settable liquid in the cut trench with stripped soil material to produce a hardening suspension.

25. Method according to claim 20, wherein the gas is air.

* * * * *